US007039208B2

(12) United States Patent
Wagner et al.

(10) Patent No.: US 7,039,208 B2
(45) Date of Patent: May 2, 2006

(54) BEHIND-THE-EAR HOUSING FUNCTIONING AS A SWITCH

(75) Inventors: Josef Wagner, Lachen (CH); Daniel Oertli, Rapperswil (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 10/212,994

(22) Filed: Aug. 5, 2002

(65) Prior Publication Data

US 2004/0062410 A1 Apr. 1, 2004

(51) Int. Cl.
*H04R 25/00* (2006.01)

(52) U.S. Cl. ..... 381/322; 381/330

(58) Field of Classification Search ..... 381/312, 381/322, 324, 330, 381
See application file for complete search history.

(56) References Cited

U.S. PATENT DOCUMENTS

| | | | | |
|---|---|---|---|---|
| 4,947,439 | A * | 8/1990 | Buettner | 381/323 |
| 5,341,433 | A * | 8/1994 | Meyer et al. | 381/324 |
| 5,738,934 | A * | 4/1998 | Jones | 428/220 |
| 6,106,358 | A * | 8/2000 | McKenzie | 446/299 |
| 2002/0071584 | A1* | 6/2002 | Rudolph et al. | 381/322 |
| 2003/0094355 | A1* | 5/2003 | Angst | 200/302.1 |

FOREIGN PATENT DOCUMENTS

| | | | |
|---|---|---|---|
| DE | 196 33 727 | C | 9/1997 |
| DE | 100 48 336 | C | 5/2002 |
| EP | 0 128 529 | A | 12/1984 |
| EP | 0 278 018 | A | 8/1988 |
| EP | 0 548 379 | A | 6/1993 |
| WO | 80 00048 | A | 1/1980 |

* cited by examiner

*Primary Examiner*—Sinh Tran
*Assistant Examiner*—Brian Ensey
(74) *Attorney, Agent, or Firm*—Pearne & Gordon LLP

(57) ABSTRACT

A housing (3) for electrical and/or electronic microdevices, in particular hearing aids (1), encompassing at least one switchable element or switching circuit system, is provided with a pressure-sensitive, bendable and/or elastic section (11). That section is functionally connected to the said switching element or circuit system in such fashion that applying pressure on the housing or bending or deforming the elastic section (11) triggers a switching operation of the switching element or circuit system.

14 Claims, 1 Drawing Sheet

BEHIND-THE-EAR HOUSING FUNCTIONING AS A SWITCH

FIELD OF THE INVENTION

This invention relates to a housing for electrical and electronic microdevices, containing at least one switchable element or switching circuit system, to a hearing aid with a housing, and to a method for operating a hearing aid.

BACKGROUND OF THE INVENTION

When on a hearing aid electrical or acoustic settings are to be changed, this is accomplished by means of controls on the device or by a remote control. These control elements are switches, potentiometers and the like, collectively referred to as control elements.

In view of the small dimensions of the device the control elements are quite tiny, requiring ultradexterous fingers for operating these elements. Since wearers of hearing aids are usually members of the older generation, it is often very difficult for them to manipulate such microcontrols. While a remote control unit can certainly overcome that problem, it is not always viewed as a desirable solution, and when the remote is misplaced as can easily happen, operation of the device is rendered altogether impossible.

BRIEF SUMMARY OF THE INVENTION

It is therefore an objective of this invention to introduce a system for operating hearing aids whereby for instance elderly persons or even someone wearing gloves with consequently reduced dexterity can operate a hearing aid, to the extent manually possible, in simple fashion.

This objective is achieved by means of a housing for electrical or electronic microdevices, in particular hearing aids.

According to the solution proposed, the housing such as that especially of a hearing aid, containing at least one switchable element or switching circuit system, includes a bendable and/or elastic or pressure-sensitive section that is functionally connected to the switching element or circuit in such fashion that a bending motion or compression or deformation of the elastic or pressure-sensitive section can trigger a switching operation.

Predominantly in elongated housings as commonly used for hearing aids, it is preferably a central segment or a central or end section of the housing that is constructed as a bendable or resiliently deformable region.

Especially in the case of hearing-aid housings, typically consisting of a polymer material, it is possible and desirable to produce a housing that is composed of an essentially rigid section and, as mentioned, a bendable or resiliently deformable i.e. elastic section employing so-called 2K injection molding technology. By that methodology it is possible to simultaneously produce, in one operation, both what ultimately serves as the essentially rigid, nonresilient polymer and the bendable or elastically deformable polymer, especially an elastomer, by simultaneous injection in one single mold.

Other preferred implementation variants of the housing according to this invention, in particular of a housing for hearing aids.

Also proposed is a method for operating a hearing aid utilizing a housing as defined in this invention. According to the invention, bending or deforming the bendable or resiliently compressible section can trigger or change specific functions within the hearing aid.

In one design variant, it is possible to activate different functions depending on the way and the duration of such activation, functions such as switching the hearing aid on and off, adjusting the volume, compensating for ambient noise, etc.

The hearing aid is preferably operated by applying one's fingers, for instance the index finger and the thumb, to corresponding end sections of the hearing-aid housing.

BRIEF DESCRIPTION OF THE SEVERAL VIEWS OF THE DRAWINGS

The following will explain this invention in more detail based on a design example and with reference to the attached drawing in which.

DETAILED DESCRIPTION OF THE INVENTION

Figure 1:
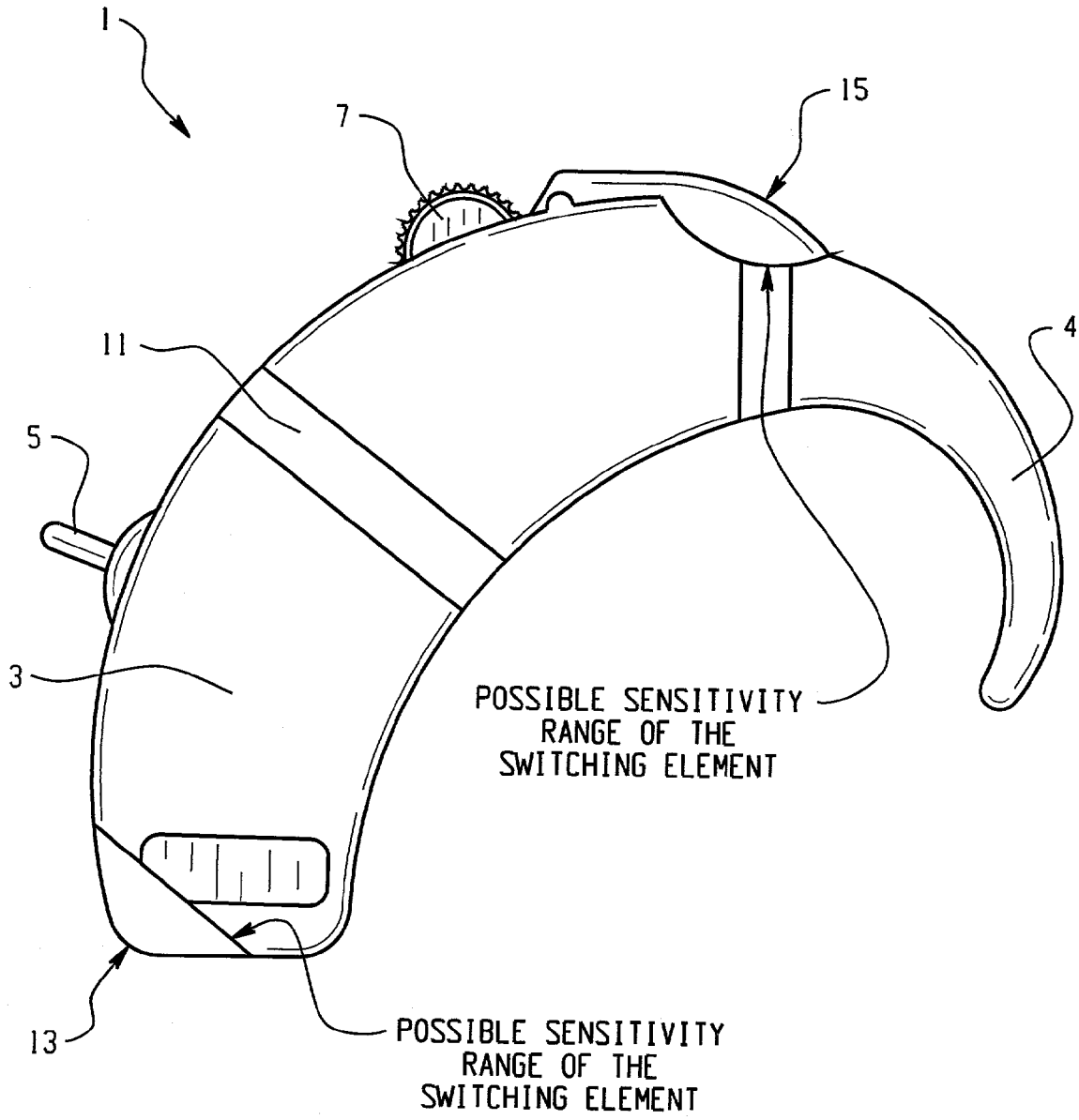
FIG. 1 illustrates a hearing aid, i.e. the housing of a hearing aid, according to this invention.

The hearing aid 1 shown in FIG. 1 encompasses a so-called behind-the-ear housing primarily including an inflexible, rigid housing section 3 and terminal bracket 4 designed to permit positioning of the hearing aid behind the ear. For the operation of the hearing aid the housing is equipped with different switching elements such as an on/off switch 5 or a volume control 7. Because of the ultra-small dimensions of these two switching elements it is evident that operating the hearing aid depicted in FIG. 1 is possible only if the wearer has the necessary micromotorial dexterity, failing which it would be difficult at best to operate these controls.

This invention therefore proposes the positioning of a bendable or resiliently deformable section 11 in the central area of the housing 3, which can be bent or compressed by applying pressure at the two actuating pressure points 13 and 15. For example, the index finger may push against pressure point 15, the thumb against point 13. Bending the hearing-aid housing causes the hearing aid to be switched on or off. Extending the duration of the bending or compressive deformation of the center section of the housing 3 may serve for volume control, as an example. It would also be possible by means of a double bending action to access different functions within an electronic menu.

Of course, a variety of other conceptual embodiments of the hearing aid are possible, for instance by positioning pressure-sensitive elements or switches, designed to trigger different functions, in the bendable section. As another possibility, the elastomer may be made electrically conductive, allowing additional functions to be activated by a manipulation or deformation of the elastic section.

It is equally possible, however, for the two regions 13 and 15, serving as pressure points actuated by the application of finger pressure, to be made electrically conductive through the use of an electrically conductive polymer. This would add another functional capability for instance by touching both regions 13 and 15 at the same time.

The big advantage of the hearing-aid housing illustrated in FIG. 1 is its ease of operation, in that the dimensions of the housing constituting the operating controls fairly match the size of the human finger, making for convenient manipulation. The actuators can be integrated in the housing so that it is possible for instance to eliminate altogether the controls 5 and 7, shown in FIG. 1, which obviates the need for providing the housing with openings for these controls. This also keeps out undesirable environmental factors such as humidity and the like.

The invention claimed is:

1. A housing for a hearing aid, comprising:

a housing body for the hearing aid, wherein a portion of the housing body is resiliently deformable; and at least one switchable element or switching circuit system coupled to the housing body, wherein bending of the entire housing body about a longitudinal axis of the housing body can actuate a switching operation of the at least one switchable element or switching circuit system.

2. The housing as in claim 1, wherein the housing body is designed as an oblong object and that the resiliently deformable portion of the housing body is located or created in the central region of the housing body.

3. The housing as in claim 1, wherein the housing body and the resiliently deformable portion of the housing body consist of polymer materials having different moduli of elasticity, allowing the housing body and the resiliently deformable portion of the housing body to be produced by the 2K injection molding method.

4. A method for operating a hearing aid comprising a housing as per claim 1, wherein bending or deforming the elastic section serves to actuate or change one or several functions.

5. The method as in claim 4, wherein by selecting a mode and duration of an actuation, different functions including on/off, volume control and ambient noise compensation can be chosen.

6. The method as in claim 5, wherein for the actuation a finger is applied to each end of the hearing-aid housing.

7. A housing for a hearing aid, comprising:

a housing body for the hearing aid; and at least one switchable element or switching circuit system, wherein the housing body includes a resiliently deformable section functionally coupled to the switching element or circuit in such fashion that bending of the resiliently deformable section can trigger a switching operation, wherein at the ends of the housing body on opposite sides relative to the resiliently deformable section portion of the housing body, actuating pressure points are provided which, when subjected to pressure applied manually or with a tool, can produce a bending motion or a deformation of the housing body.

8. The housing as in claim 7, wherein the resiliently deformable section and/or the actuating points to be subjected to pressure are made of an electrically conductive polymer.

9. A hearing aid comprising:

a housing body for the hearing aid having a rigid section and an elastic section; and at least one switchable element or switching circuit system positioned inside the housing body, wherein bending of the entire housing body about a longitudinal axis of the housing body can trigger a switching operation of the at least one switchable element or switching circuit system.

10. A hearing aid comprising:

a housing; and at least one switchable element or switching circuit system, wherein the housing includes a resiliently deformable section functionally coupled to the switching element or circuit in such fashion that bending of the resiliently deformable section of the housing can trigger a switching operation, wherein the housing is designed as a behind-the-ear hearing-aid housing curved to follow the anatomy of an auricula and wherein the resiliently deformable elastic section is provided in its central region as a strip-shaped section extending in a direction perpendicular to the longitudinal axis of the housing.

11. A housing for a hearing aid comprising:

a first rigid section having a first pressure point;

a second rigid section having a second pressure point; and a resiliently deformable section positioned between the first rigid section and the second rigid section;

wherein the resiliently deformable section is adapted to bend and effect a switching operation for the hearing aid when pressure is applied to at least one of the first and second pressure points.

12. The housing of claim 11, wherein at least one of the first and second pressure points are conductive pressure points.

13. The housing of claim 11, wherein the housing is adapted to be positioned behind an ear of a user.

14. The housing of claim 11, wherein the resiliently deformable section is positioned at a central area of the housing.

* * * * *